US006793706B1

(12) United States Patent
Hebsur

(10) Patent No.: US 6,793,706 B1
(45) Date of Patent: Sep. 21, 2004

(54) OXIDATION RESISTANT AND LOW COEFFICIENT OF THERMAL EXPANSION NIAL-COCRALY ALLOY

(75) Inventor: Mohan G. Hebsur, North Olmsted, OH (US)

(73) Assignee: Ohio Aerospace Institute, Cleveland, OH (US)

( * ) Notice: Subject to any disclaimer, the term of this patent is extended or adjusted under 35 U.S.C. 154(b) by 4 days.

(21) Appl. No.: 10/238,231

(22) Filed: Sep. 10, 2002

Related U.S. Application Data

(62) Division of application No. 09/675,846, filed on Sep. 29, 2000, now Pat. No. 6,454,992.

(51) Int. Cl.[7] ..... C22C 32/00
(52) U.S. Cl. ..... 75/244
(58) Field of Search ..... 75/244

(56) References Cited

U.S. PATENT DOCUMENTS

| | | | | |
|---|---|---|---|---|
| 4,321,311 A | 3/1982 | Strangman | 428/623 |
| 4,405,659 A | 9/1983 | Strangman | 427/248.1 |
| 5,230,924 A | 7/1993 | Li | 427/229 |
| 5,514,482 A | 5/1996 | Strangman | 428/623 |
| 5,635,654 A | 6/1997 | Hebsur et al. | 75/244 |
| 5,916,382 A | 6/1999 | Sato et al. | 148/404 |
| 5,952,110 A | 9/1999 | Schell et al. | 428/621 |
| 5,981,091 A | 11/1999 | Rickerby et al. | 428/670 |
| 6,454,992 B1 * | 9/2002 | Hebsur | 419/32 |

OTHER PUBLICATIONS

HITEMP Review, 1989, Advanced High Temperature Engine Materials Technology Program, NASA Conference Publications 10039, "Oxidation of Aluminides", Joseph Doychak et al.

Thermal Barrier Coating Workshop, NASA Conference Publication 3312 (1995), "Properties of Plasma Sprayed Bond Coats", W. J. Bindley.

MRS Proceedings Reprint, Mat. Res. Soc. Symp. Proc. vol. 364, NiAl–Base Composite Containing High Volume Fraction of AlN Particulate for Advanced Engines, Mohan G. Hebsur et al., pp. 579–584.

Oxidation of Metals, vol. 12, No. 4, 1978, The Cyclic Oxidation Resistance of Cobalt–Chromium–Aluminum Alloys at 1100 and 1200° C. and a Comparison with the Nickel–Chromium–Aluminum Alloy System, Charles A. Barrett et al., pp. 293–311.

* cited by examiner

*Primary Examiner*—Daniel Jenkins
(74) *Attorney, Agent, or Firm*—Pearne & Gordon LLP

(57) ABSTRACT

A bond coat composition for use in thermal barrier coatings comprises a NiAl—CoCrAlY matrix containing particles of AlN dispersed therein. The bond coat composition is prepared by croymilling NiAl and CoCrAlY in liquid nitrogen.

10 Claims, 6 Drawing Sheets

OXIDATION RESISTANT AND LOW COEFFICIENT OF THERMAL EXPANSION NIAL-COCRALY ALLOY

This application is a division of application Ser. No. 09/675,846, filed Sep. 29, 2000 now U.S. Pat. No. 6,454,992.

This invention was made with Government support under Contract No. 3637 by NASA. The Government has certain rights to the invention.

BACKGROUND OF THE INVENTION AND RELATED ART

The present invention relates to NiAl-based intermetallic composites, and more particularly, to a new NiAl—CoCrAlY bond coat optionally having particulate AlN dispersed therein. The bond coat has particular application as part of a thermal barrier coating for metallic components used in high temperature applications.

Multilayer thermal barrier coatings on superalloy substrates are comprised of an intermetallic bond coat, a thermal grown oxide layer and a zirconia top coat that provides thermal protection. Known bond coats include CoCrAlY and NiCrAlY. These bond coats are alumina formers and provide oxidation resistance. However, because of the low aluminum content of these bond coat materials, their oxidation resistance is limited to shorter times and lower temperatures then desired in many applications. Further, their coefficient of thermal expansion mismatch with the zirconia thermal barrier coating causes rapid degradation.

In accordance with the present invention, a bond coat with improved long-term oxidation resistance and coefficient of thermal expansion compatibility with the thermal barrier coating is provided.

SUMMARY OF INVENTION

It has now been found that NiAl and CoCrAlY may be combined to provide improved bond coats. The performance of the bond coat may be further enhanced with the dispersion therein of particulate AlN.

AlN is believed to operate to enhance oxidation resistance by providing an aluminum source useful to form alumina scale. In addition to enhancing oxidation resistance, AlN has also been found to reduce the coefficient of thermal expansion of the resulting composite to more closely match that of the ceramic thermal barrier coat, e.g. zirconia. Accordingly, the resulting composite is characterized by increased oxidation resistance and thermal fatigue properties.

The NiAl and CoCrAlY alloy may include 15 to 30 volume percent CoCrAlY, the balance being NiAl. The NiAl may be at 50 to 55 atom percent.

The NiAl—CoCrAlY—AlN composite may comprise about 10 to 15 volume percent AlN, 15 to 30 volume percent CoCrAlY and the balance is NiAl. Good results have been obtained with about 10 volume percent AlN and 15 volume percent CoCrAlY, the remainder being NiAl.

A further improvement provided by the AlN particulate is increased mechanical strength. More particularly, the modulus of the resulting composite is increased.

The NiAl—CoCrAlY—AlN composite is lightweight, tough and highly creep resistant. The composite also has good thermal conductivity.

Cryomilling may be used in the preparation of the composite. More particularly, NiAl and CoCrAlY may be mixed and cryomilled in liquid nitrogen with the use of a grinding media. During the subsequent forming and heating of the composite, the AlN is formed as a particulate dispersion within the NiAl—CoCrAlY matrix.

DETAILED DESCRIPTION OF THE INVENTION

The NiAl—CoCrAlY alloy may be formed using conventional melting techniques and elemental constituients. Also, mechanical alloying may be used by mixing elemental constitutents or master alloy powders, NiAl and CoCrAlY, in proportion and milling it to form NiAl—CoCrAlY alloy. As noted above, the CoCrAlY may comprise 15 to 30 volume percent of the alloy. Also, an 85/15 volume percent ratio may be used. The NiAl—CoCrAlY alloy may be used as a bond coat for Ni-based superalloys, but its properties may be further improved with the addition of particulate AlN as discussed below.

The NiAl—CoCrAlY—AlN composite of the present invention is prepared using cryomilling. The component NiAl and CoCrAlY alloys may be prepared from elemental constituents in accordance with known techniques or purchased from commercial sources. In the following example, a prepared NiAl alloy is, combined with a commercially available CoCrAlY.

In preparation for cryomilling, about 85 percent by volume of prealloyed NiAl (50 atom percent) and 15 percent by volume of a commercially supplied CoCrAlY alloy were mixed and cryomilled in a Union Process 01-HDT attritor. The grinding media comprised 304 stainless-steel balls of ¼ inch diameter. The milling was carried out in the presence of liquid nitrogen for about 16 hours. The outer jacket of the vessel was also cooled with liquid nitrogen. The milled powder was consolidated by hot extrusion or by hot isostatic pressing.

Figure 1:
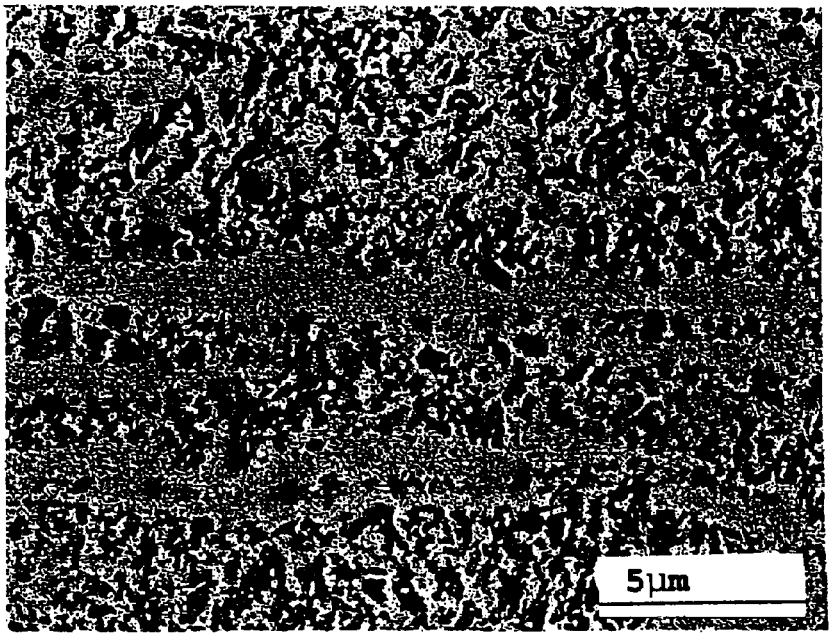
FIG. 1 is a micrograph showing extruded NiAl—CoCrAlY—AlN.
Figure 1A:
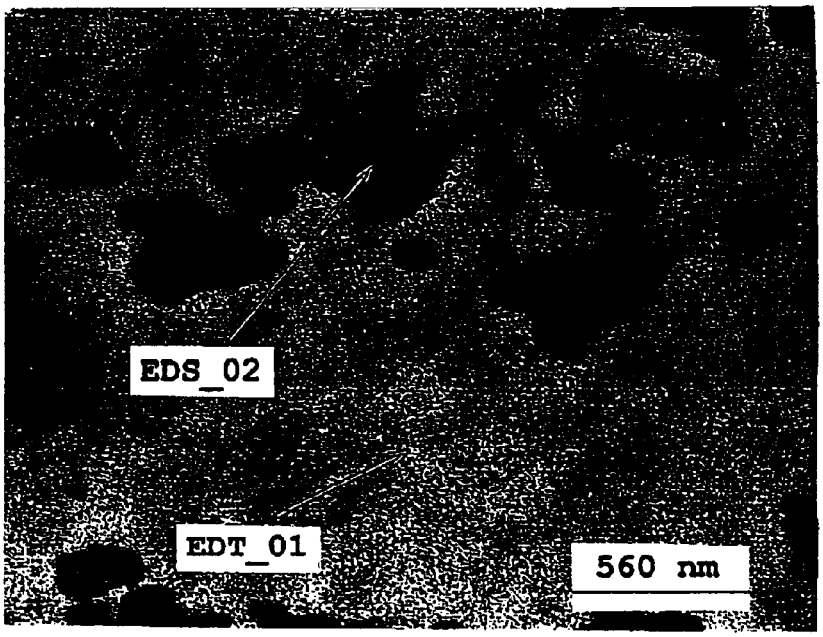
FIG. 1A is a micrograph similar to FIG. 1 showing various phases of the NiAl—CoCrAlY—AlN.

Referring to FIG. 1, an SEM micrograph shows the NiAl—CoCrAlY—AlN composite as extruded. The elongated grains of NiAl are particularly illustrated. Referring to FIG. 1A, the light phase corresponds with the (NiCo)Al phase and a dark mantle region consists of nanosized AlN particles. The AlN particles range in size from 10 to 50 nanometers.

The consolidated material was used to form oxidation coupons, 4 point bend and tensile specimens. These were machined from the consolidated material.

Figure 2:
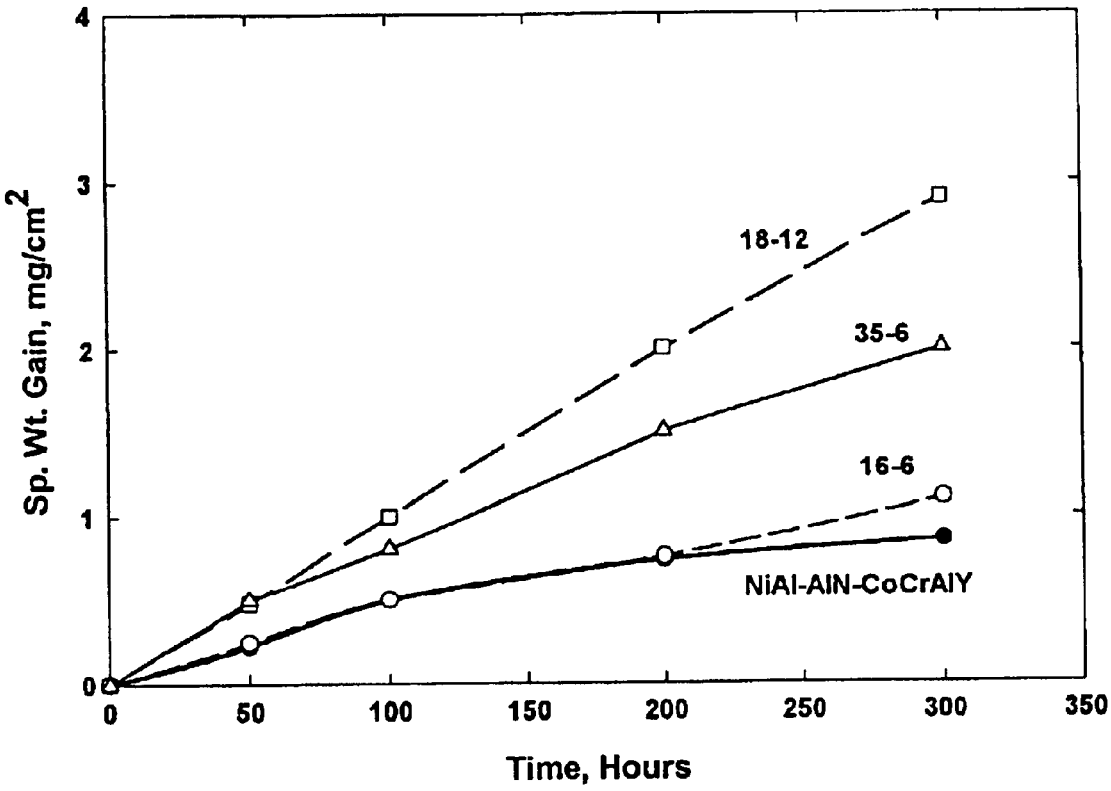
FIG. 2 shows a comparison of 1100° C. isothermal oxidation weight gain of NiAl—CoCrAlY—AlN and other MCrAlY bond coat alloys.

Isothermal oxidation tests were carried out between 1100° C. and 1400° C. for 200 hours. Referring to FIG. 2, a plot of the specific weight gain vs. time for the NiAl—CoCrAlY—AlN composite of the invention and several other currently used MCrAlY bond coat alloys is shown. Only the 16-6 (16% Cr and 6% Al) alloy showed comparable performance with that of the inventive composite up to about 200 hours. Thereafter, the NiAl—CoCrAlY—AlN composite is characterized by a lower specific weight gain.

Figure 3:
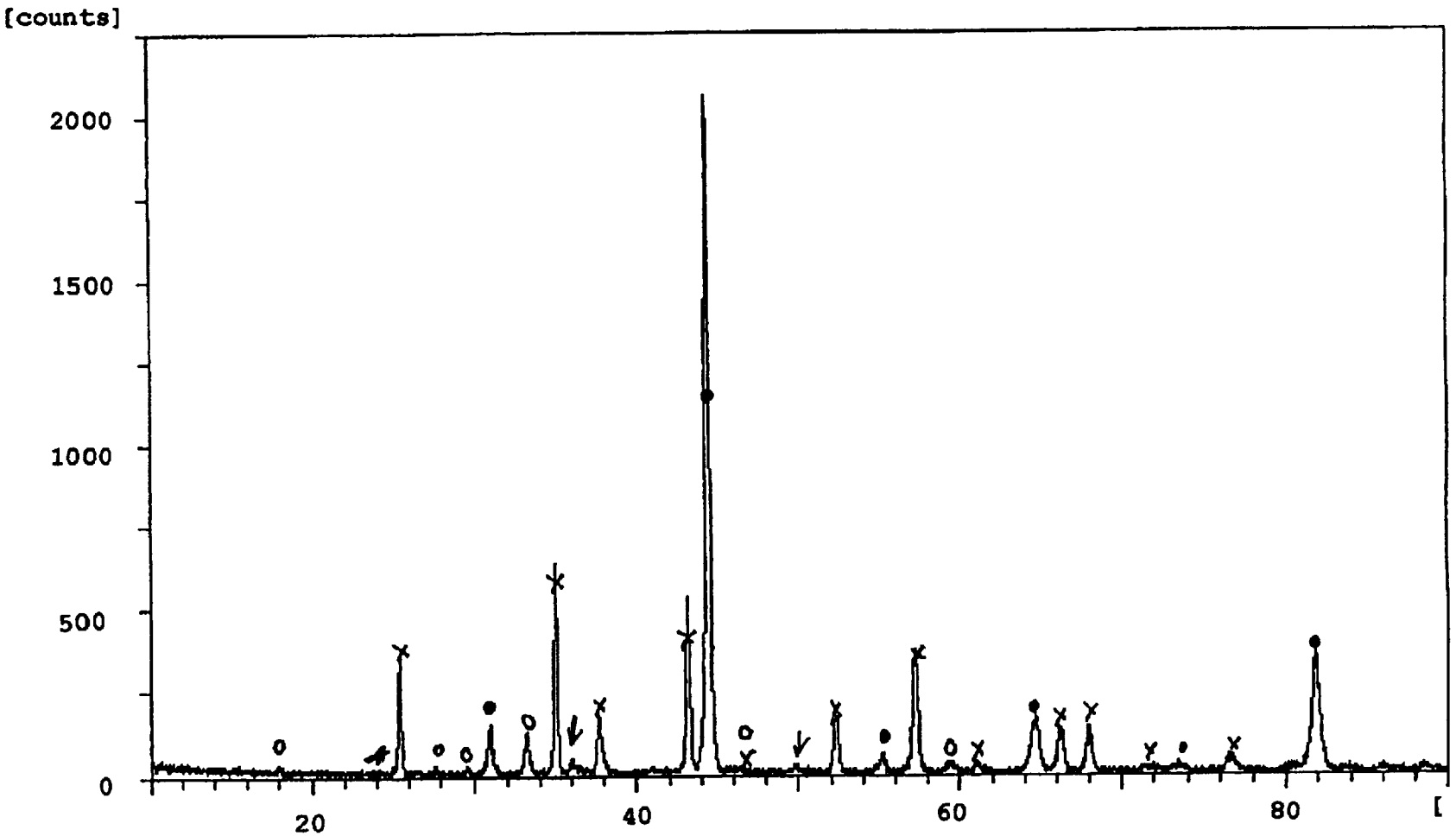
FIG. 3 shows an x-ray diffraction pattern of a specimen of oxidized NiAl—CoCrAlY—AlN.

Referring to FIG. 3, an x-ray diffraction pattern for an oxidized specimen of NiAl—CoCrAlY—AlN is shown. The peak corresponds with alumina. SEM analysis showed that the alumina scale is continuous, very compact and thin. This agrees with the effective oxidation resistance displayed by the NiAl—CoCrAlY—AlN composite and the low specific weight gain observed.

Figure 4:
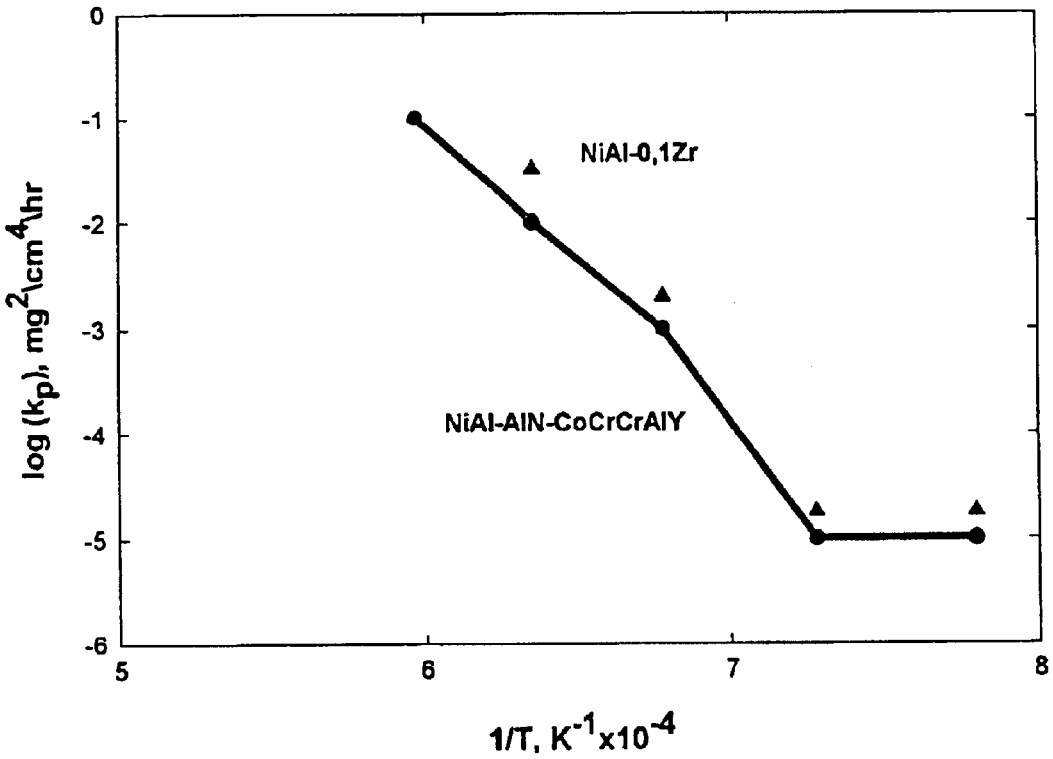
FIG. 4 shows a comparison of the parabolic oxide growth rates of NiAl-0.1Zr and NiAl—CoCrAlY—AlN.

Referring to FIG. 4, the Arrhanius plot shows the relationship of the parabolic scaling oxide constant ($k_p$) and 1/T for NiAl—CoCrAlY—AlN and NiAl0.1Zr. The $k_p$ values for NiAl—CoCrAlY—AlN are lower than those of NiAl0.1Zr alloy and indicate a lower rate of forming alumina for all temperatures.

Cyclic oxidation tests were performed at 1160° C. and 1200° C. for 200 cycles in air. Each cycle consisted of one-hour heating and 20 minutes of cooling. For purposes of comparison, the cyclic oxidation of CoCrAlY under these conditions was also tested. The results are reported in FIG. 5.

Figure 5:
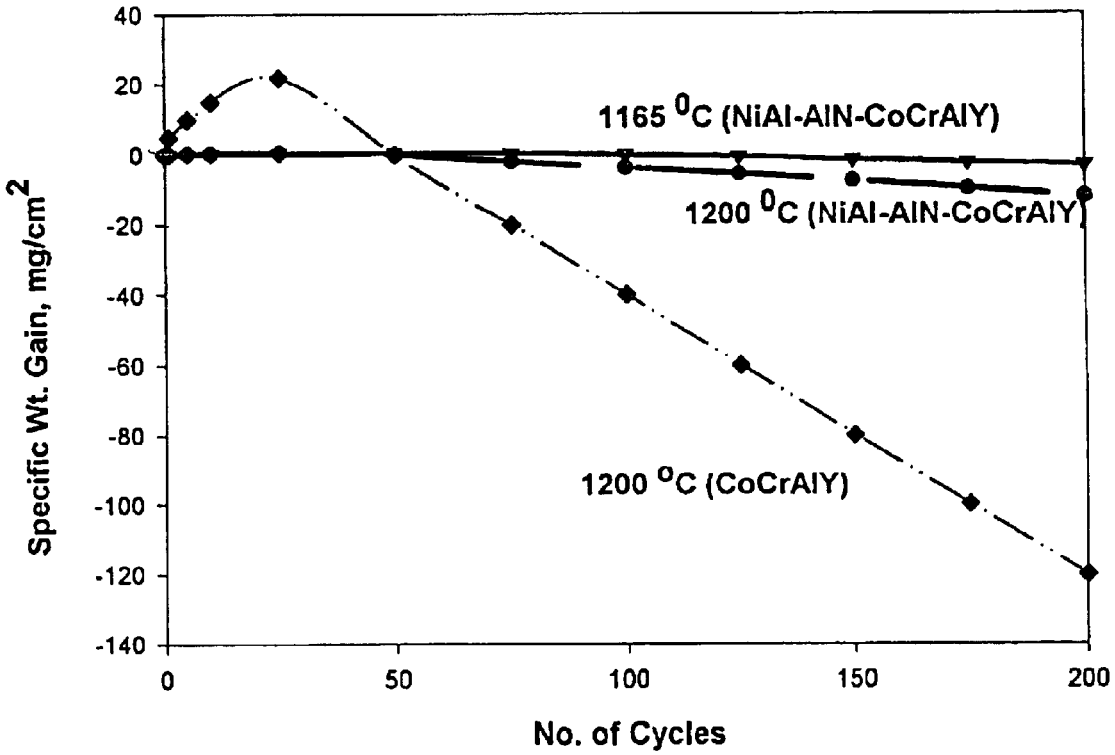
FIG. 5 shows a comparison of the cyclic oxidation of a CoCrAlY alloy with NiAl—CoCrAlY—AlN.

Referring to FIG. 5, the CoCrAlY alloy displays a much lower specific weight gain at 50 cycles or higher indicating a greater degree of spallation. In comparison, NiAl—CoCrAlY—AlN at 200 cycles had a specific weight gain of −3 mg/cm2 at 1165° C. and −13 mg/cm2 at 1200° C.

Figure 6:
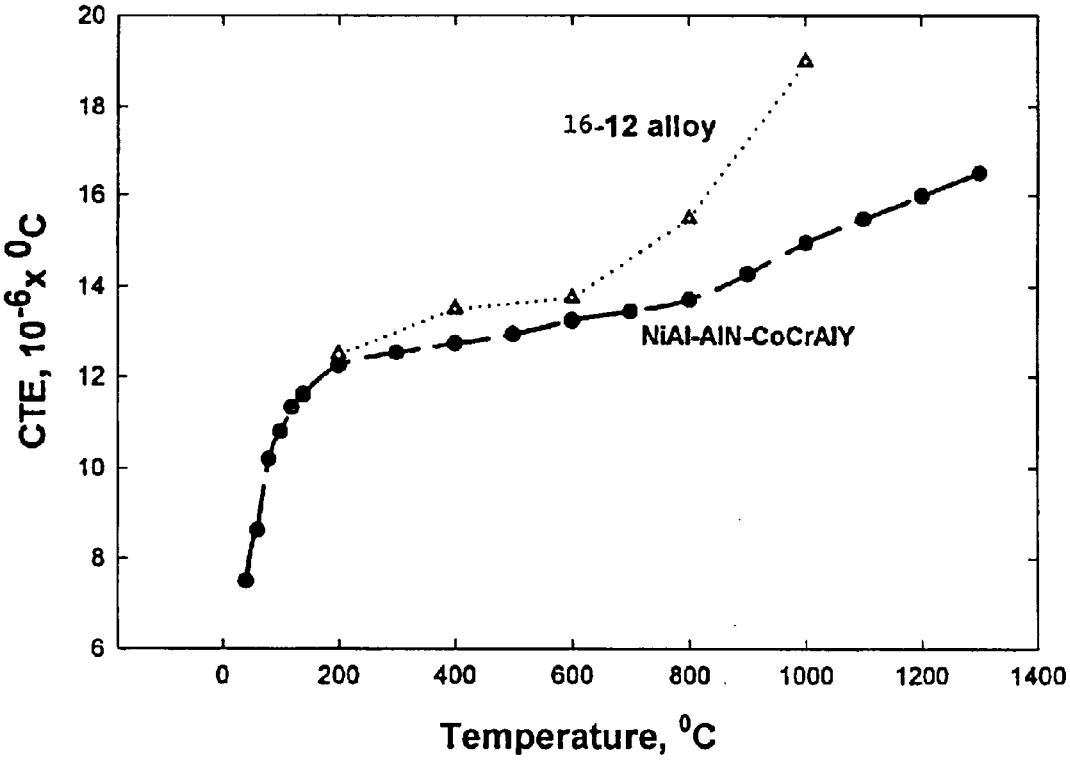
FIG. 6 shows a comparison of the coefficient of thermal expansion vs. temperature for NiAl—CoCrAlY—AlN and 16-12 alloy.

The coefficient of thermal expansion of freestanding NiAl—CoCrAlY—AlN was measured at temperatures ranging from 20° C. to 1000° C. in an argon atmosphere. The average coefficient of thermal expansion is plotted against temperature in FIG. 6. For comparison purposes, a commercially used 16-12 bond coat alloy (16% Cr and 12% Al) was also tested, and the results are included in FIG. 6. As shown, the NiAl—CoCrAlY—AlN composite had a lower coefficient of thermal expansion. At temperatures of about 1150° C., the coefficient of thermal expansion is less than about 16 for the NiAl—CoCrAlY—AlN composite.

Figure 7:
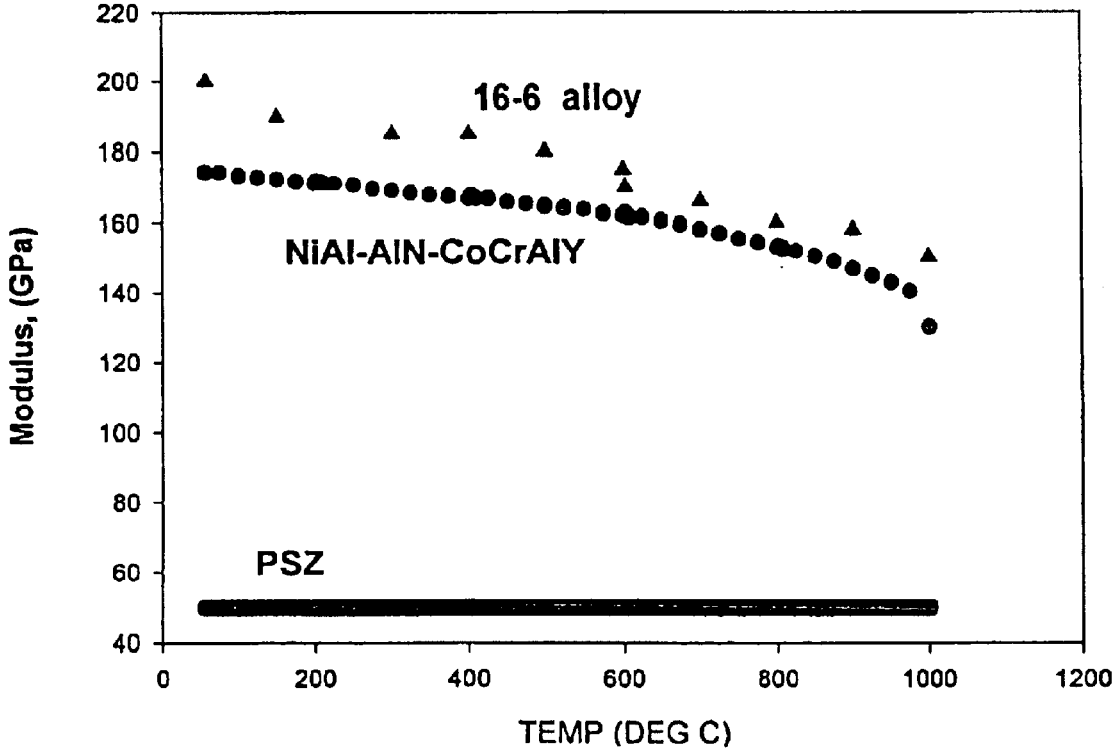
FIG. 7 shows dynamic Young's Modulus vs. temperature for NiAl—CoCrAlY—AlN, 16-6 alloy and partially stabilized zirconia.

Tensile tests were carried out on butterhead type specimens between room temperature and 1000° C. The dynamic Young's modulus values were measured and correlated with temperature, the data being plotted in FIG. 7. In addition to the NiAl—CoCrAlY—AlN alloy, similar measurements were made for a 16-12 alloy and a plasma sprayed, partially stabilized zirconia (PSA) alloy. As shown, both of the bond coats have a much higher modulus then in the thermal barrier coat which is porous. Since the elastic stress generated in the coating will be dominated by the lower modulus material, it is evident that the ceramic layer modulus will determine the stress in the thermal barrier coating up to the operating temperature.

The most important property of a bond coat is, of course, the thermal fatigue life of the thermal barrier coating system for that bond coat. The fatigue lives of thermal bond coatings having an air plasma sprayed ceramic top coat and a low pressure plasma spray applied NiAl—CoCrAlY—AlN bond coat or a 16-6 bond coat were evaluated using a jet-fuel fired Mach 0.3 burner rig to simulate gas turbine conditions. A JP-5 fuel was used in the burner. Samples were heated in the burner for six minutes to a steady state temperature of 1160° C. and then forced-air cooled for 4 minutes during each cycle.

Figure 8:
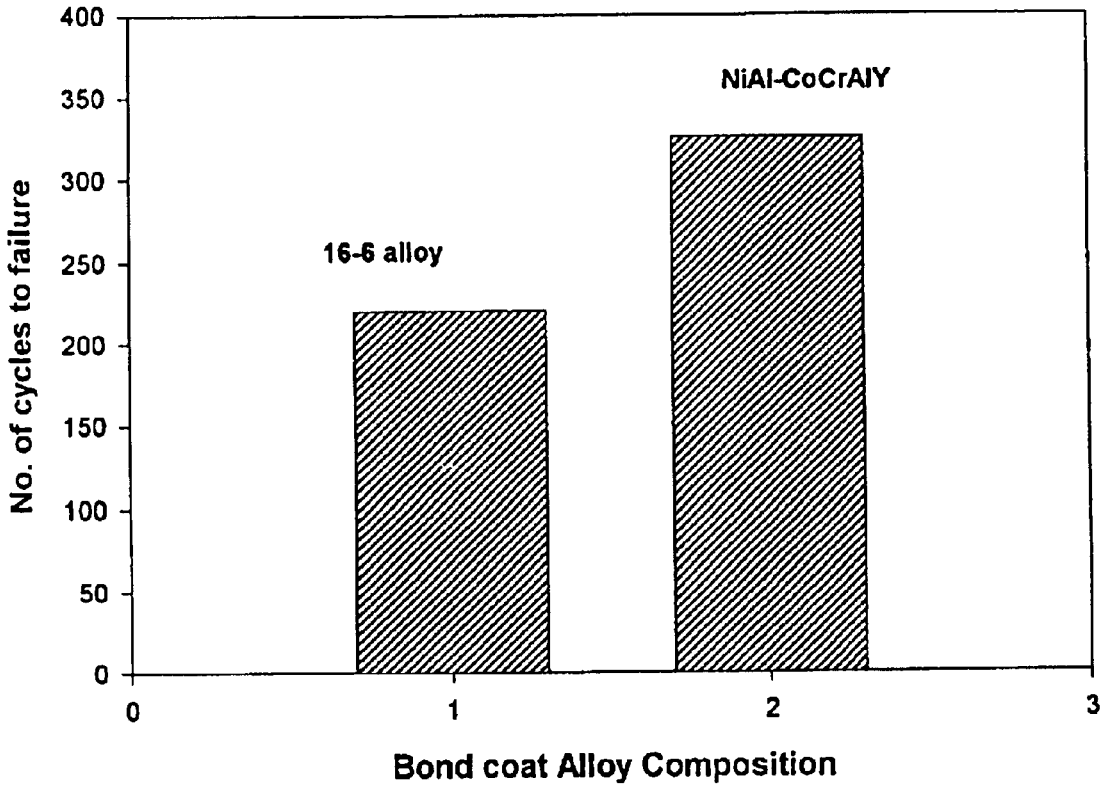
FIG. 8 shows a comparison of the thermal cycle lives of two layered thermal barrier coatings with 16-6 bond coat and NiAl—CoCrAlY—AlN bond coat.

The results of the thermal cycle testing are reported in FIG. 8. As shown, the 16-6 alloy (16% Cr and 6% Al) had a cycle life of about 220 cycles and the NiAl—CoCrAlY—AlN composite of the invention had a cycle life of about 325 cycles. This corresponds to about a 50 percent increase in cycle life.

What is claimed is:

1. A particulate reinforced NiAl—CoCrAlY—AlN composite comprising:

a NiAl—CoCrAlY matrix having particles of AlN dispersed therein, said composite containing from about 10 to about 15 volume percent of said AlN particles.

2. A composite as in claim 1, wherein said composite further comprises from about 15 to about 30 volume percent CoCrAlY and the remainder is NiAl.

3. A composite as in claim 2, having an average coefficient of thermal expansion of less than about 16 ppm/° C. at temperatures less than 1150° C.

4. A composite as in claim 2, having a cyclic oxidation resistance at 200 cycles and 1165° C. of about −3 mg/cm2.

5. A composite as in claim 2, having a cyclic oxidation resistance at 200 cycles and 1200° C. of about −13 mg/cm2.

6. A composite as in claim 2, wherein said AlN particles have a size in the range of from about 10 to about 50 nanometers.

7. A composite as in claim 1, wherein said composite consists essentially of NiAl, CoCrAlY and AlN.

8. A bond coat having a reduced coefficient of thermal expansion for use in a thermal barrier coating for Ni-based superalloys comprising a particulate reinforced NiAl—CoCrAlY—AlN composite including:

a NiAl—CoCrAlY matrix having particles of AlN dispersed therein, said composite further comprising from about 15 to about 30 volume percent CoCrAlY, the remainder being NiAl.

9. A bond coat as in claim 8, wherein said matrix and particulate are formed by cryomilling NiAl and CoCrAlY in liquid nitrogen.

10. A bond coat as in claim 9, securing a Ni-based superalloy to a zirconia thermal barrier.

* * * * *